US005916254A

United States Patent [19]

Cho

[11] Patent Number: 5,916,254

[45] Date of Patent: Jun. 29, 1999

[54] METHOD OF CIRCULATING REFRIDGERANT FOR DEFROSTING AND REFRIGERATOR EMPLOYING THE SAME

[75] Inventor: Hee-Cheol Cho, Seoul, Rep. of Korea

[73] Assignee: Daewoo Electronics Co., Ltd., Rep. of Korea

[21] Appl. No.: 08/866,082

[22] Filed: May 30, 1997

[30] Foreign Application Priority Data

Aug. 31, 1996 [KR] Rep. of Korea ..... 96-37505

[51] Int. Cl.[6] ..... F25B 47/02

[52] U.S. Cl. ..... 62/278; 62/324.5

[58] Field of Search ..... 62/81, 278, 324.5

[56] References Cited

U.S. PATENT DOCUMENTS

| | | | |
|---|---|---|---|
| 2,878,654 | 3/1959 | Kramer | 62/278 |
| 3,167,930 | 2/1965 | Block et al. | 62/278 |
| 3,190,079 | 6/1965 | Lauer | 62/278 |
| 3,309,888 | 3/1967 | Jacobs | 62/278 |
| 4,343,157 | 8/1982 | Hattori | 62/278 |

FOREIGN PATENT DOCUMENTS 59-36481 3/1984 Japan .

*Primary Examiner*—William E. Tapolcai
*Attorney, Agent, or Firm*—Pillsbury Madison & Sutro, LLP

[57] ABSTRACT

A method of circulating a refrigerant for defrosting comprises the steps of changing a switching valve installed at a discharge pipe and a suction pipe of a compressor to a defrosting mode according to a control signal from a controller; and directly transferring the refrigerant compressed to a high-temperature and high-pressure gas at the compressor to an evaporator to remove a frost formed on the evaporator. A refrigerator having a compressor, a condensor, a capillary tube and an evaporator, in which a refrigerant circulates through the compressor, the condensor, the capillary tube and the evaporator sequentially, in a refrigerating mode to perform cooling, comprises a switching valve installed at a discharge pipe and a suction pipe of the compressor, for changing a circulation direction of the refrigerant from the compressor to the evaporator, in a defrosting mode; and a controller for selectively controlling the switching valve to be switched to the defrosting mode or the refrigerating mode.

1 Claim, 2 Drawing Sheets

METHOD OF CIRCULATING REFRIDGERANT FOR DEFROSTING AND REFRIGERATOR EMPLOYING THE SAME

BACKGROUND OF THE INVENTION

1. Field of the Invention

The present invention relates to a refrigerator having a defrosting cycle, and more particularly to a method of circulating a refrigerant for defrosting and a refrigerator employing the same, in which the refrigerant compressed by a compressor is directly transferred to an evaporator to remove a frost formed on the surface of the evaporator.

2. Prior Art

Generally, a refrigerator has a cabinet having a freezer compartment and a fresh food compartment which are partioned from each other by a wall, and a freezer compartment door and a fresh food compartment door mounted on the cabinet by a hinge structure. A plularity of shelves are mounted in the freezer compartment and the fresh food compartment.

The refrigerator, as shown in FIG. 1, has a cooling system having a compressor 10 for compressing the vaporized refrigerant, an evaporator 50 for absorbing heat in the refrigerator to vaporize a refrigerant, and a condensor 20 for condensing the compressed refrigerant to emit the heat outside.

That is, the refrigerant exchanges the heat with air in the refrigerator through the evaporator 50 installed at the fresh food compartment and absorbs the heat. The refrigerant vaporized at the evaporator 50 is transferred to the compressor 10 to be compressed to a high-temperature and high-pressure gas. The compressed refrigerant is transferred to the condensor 20 to be liquefied by exchanging the heat with an outside air. The refrigerant liquefied at the condensor 20 is then passed through a drier 30 and a capillary tube 40 to change into a low-temperature and low-pressure liquid state. The refrigerant returns to the evaporator 50 to absorb a latent heat, thereby cooling the freezer and fresh food compartments.

In brief, the refrigerant absorbs the heat in the refrigerator through the evaporator 50 positioned on the fresh food compartment or the freezer compartment, and emits the absorbed heat outside through the condensor 20. During the continuous circulation of the refrigerant through the cooling system described above, the heat in the fresh food compartment and the freezer compartment is emitted outward for an effective refrigeration.

While the refrigerant exchanges the heat with air inside of the refrigerator at the evaporator 50, the difference between the temperatures of the refrigerant in the evaporator 50 and the air in the refrigerator causes a frost to be formed gradually on the surface of the evaporator 50. As a result, the frost surrounding the evaporator 50 decreases the efficiency of the heat exchange.

The operating mode of the refrigerator is switched to a defrosting mode during a predetermined period according to a defrosting signal from a controller (not shown) in order to defrost the evaporator 50.

A defrosting heater has been conventionally used to remove the frost formed on the surface of the evaporator 50. In this system, the defrosting heater is installed, and an auxiliary timer is needed to determine a switching time of the refrigerator and to control the operating time of the defrosting mode. Further, since the defrosting heater is installed at the cool air supply duct connected to the fresh food compartment, an additional accomodating space for the defrosting heater is required.

The heat generated by the operation of the defrosting heater flows into the freezer compartment to cause the temperature of the freezer compartment to increase, so that an extra refrigeration is required to prevent the temperature from increasing in the freezer compartment. Consequently, the efficiency of the compressor 10 decreases by the operation of the defrosting heater.

Another conventional defrosting system is disclosed in the Japanese Utility Model Laid-Open No. Sho 59-36481, in which refrigerant compressed to a high-temperature and high-pressure at a compressor is directly transferred to an evaporator, bypassing a condensor, and returns to the compressor after defrosting the evaporator. The system described above is superior to the defrosting heater, but since the evaporator in the defrosting cycle performs the function of the condensor, the system has a drawback in that the condensed refrigerant is difficult to vaporize before returning to the compressor.

SUMMARY OF THE INVENTION

Accordingly, it is an object of the present invention to provide a method of circulating a refrigerant for defrosting and a refrigerator employing the method in which a frost formed on the surface of an evaporator is efficiently removed without the need of a defrosting heater.

In order to achieve the above object, the present invention provides a method of circulating a refrigerant for defrosting, comprising the steps of actuating a switching valve installed at a discharge pipe and a suction pipe of a compressor to a defrosting mode according to a control signal from a controller; and transferring the refrigerant compressed to a high-temperature and high-pressure gas at the compressor to an evaporator to remove a frost formed on the evaporator.

To accomplish the above object, the present invention also provides a refrigerator having a compressor, a condensor, a capillary tube and an evaporator, in which a refrigerant circulates through the compressor, the condensor, the capillary tube and the evaporator sequentially, in a refrigerating mode to perform cooling, comprising: a switching valve installed at a discharge pipe and a suction pipe of the compressor, for changing a circulation direction of the refrigerant from the compressor to the evaporator, in a defrosting mode; and a controller for selectively controlling the switching valve to be switched to the defrosting mode or the refrigerating mode.

In accordance with the present invention, the refrigerant compressed to a high-temperature and high-pressure gas at the compressor in the defrosting mode is directly transferred to the evaporator through the switching value, to thereby easily reduce a frost formed on the surface of the evaporator. Also, the refrigerator is vaporized while passing through the auxiliary pipe before returning to the compressor, so that the compressor is not burdened by the refrigerant in its operation.

BRIEF DESCRIPTION OF THE DRAWINGS

The present invention will be better understood and its various objects and advantages will be more fully appreciated from the following description taken in conjunction with the accompanying drawings, in which.

DESCRIPTION OF THE PREFERRED EMBODIMENT

Reference will now be made in detail to the present invention, examples of which are illustrated in the accompanying drawings. Wherever possible, the same reference numbers will be used throughout the drawings to refer to the same or like parts.

Figure 1:
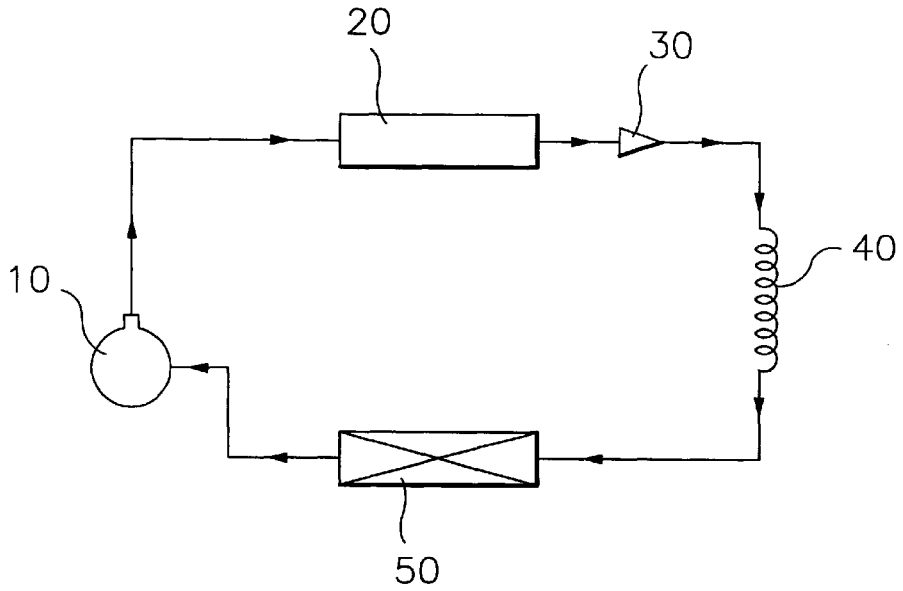
FIG. 1 (PRIOR ART)
FIG. 1 is a circulation chart of a refrigerant in a conventional refrigerator.
Figure 2:
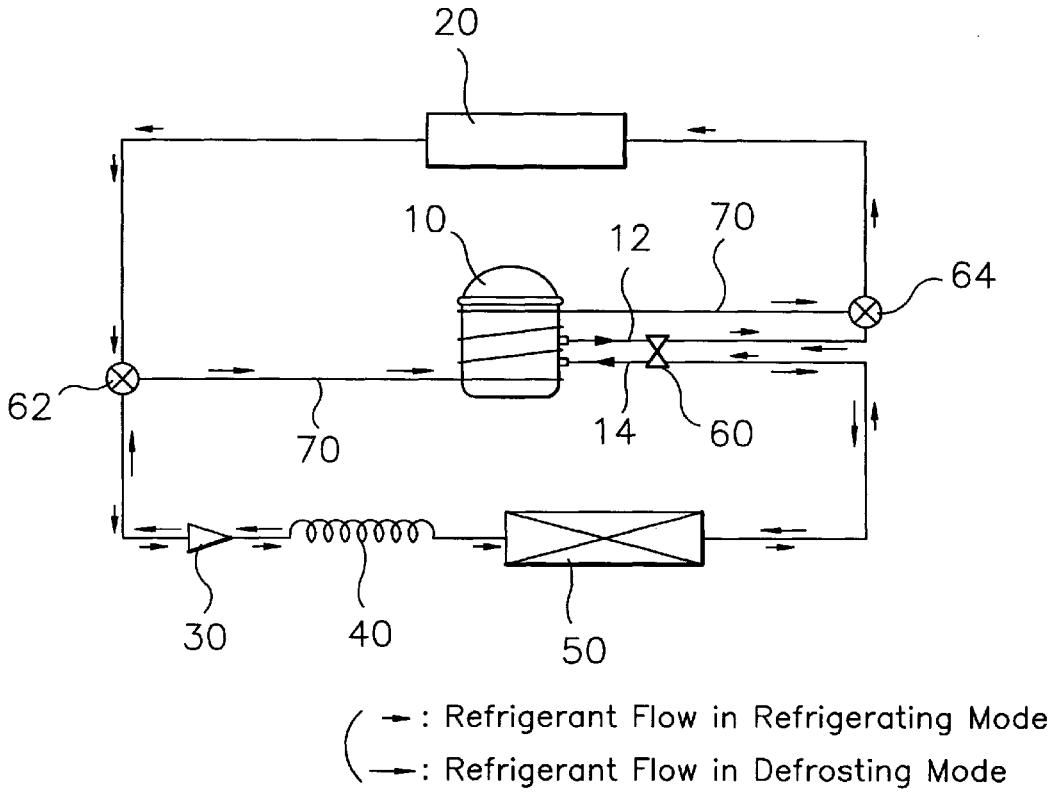
FIG. 2 is a circulation chart of a refrigerant in a refrigerator according to a preferred embodiment of the present invention.

Referring to FIG. 2, in a refrigerant circulation in a refrigerator according to the present invention, a refrigerant circulates through a compressor 10, a condensor 20, a drier 30, a capillary tube 40 and an evaporator 50, as in the conventional refrigerant circulation, during its refrigeration mode.

However, according to a feature of the present invention, when a frost formed on the evaporator 50 is removed, the operation of the refrigerator is switched from a refrigeration mode to a defrosting mode by an action of a switching valve 60 mounted at a discharge pipe 12 and a suction pipe 14 of the compressor 10 to reverse the circulation direction of the refrigerant.

In the defrosting mode, it is preferable that the refrigerant from the evaporator 50 directly returns to the compressor 10 after defrosing, not to the condensor 20. A first flow direction changing valve 62 is installed between the evaporator 50 and the condensor 20 to change the flow direction of the refrigerant to the compressor 10. A second flow direction changing valve 64 is installed between the condensor 20 and the compressor 10, and an auxiliary pipe 70 connects the first flow direction changing valve 62 and the second flow direction changing valve 64 while coiling around the compressor 10.

In the refrigerating mode, the refrigerant, as in the conventional refrigerator, is compressed to a high-temperature and high-pressure gas at the compressor 10, and transferred to the condensor 20 via the discharge pipe 12. The condensed refrigerant at the condensor 20 passes through the drier 30 and the capilliary tube 40 to absorb the latent heat in the evaporator 50 and refrigerates the freezer and fresh food compartments. It then returns to the compressor 10 through the suction pipe 14. The refrigerant circulation process described above is continuously performed during the refrigerating mode.

The switching valve 60 and the first and second flow direction changing valves 62 and 64 are actuated by a controller (not shown), to control the operating mode of the refrigerator to the refrigerating or defrosting mode. In the defrosting mode, the refrigerant passes through the compressor 10, the evaporator 50, the capilliary tube 40, the drier 30, the first flow direction changing valve 62, the auxiliary refrigerating pipe 70, and the second flow direction changing valve 64 and returns to the compressor 10 to repeat the cycle.

Figure 3:
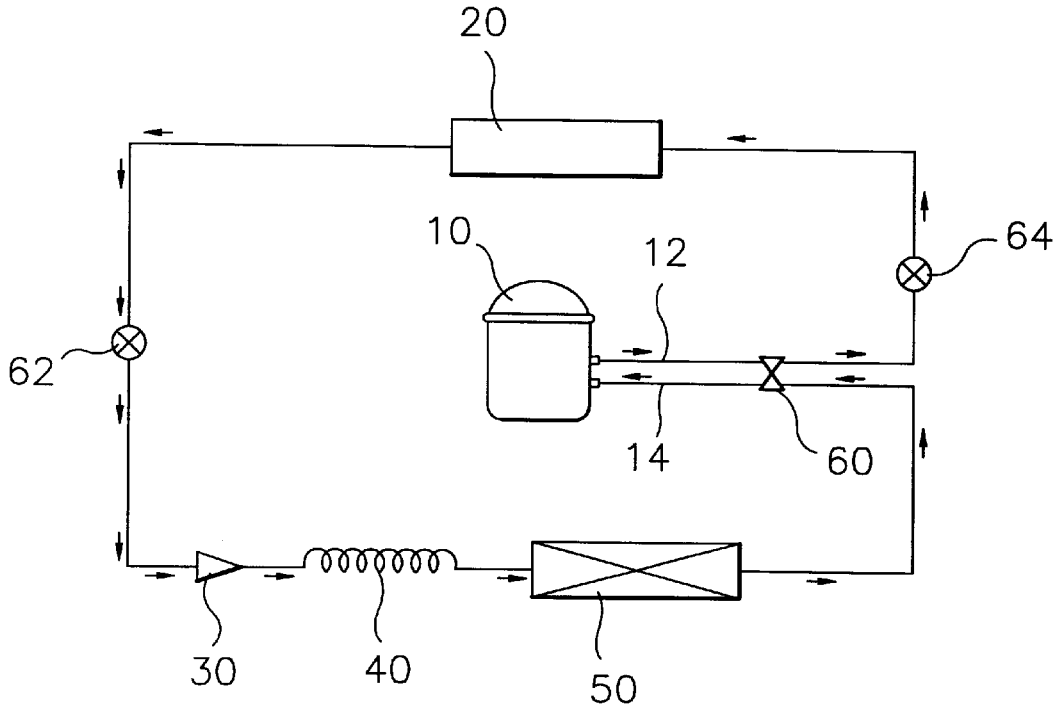
FIG. 3 is a circulation chart of the refrigerant in a refrigerating mode of the refrigerator according to the present invention.

FIG. 3 shows the circulation of the refrigerant in the refrigerating mode of FIG. 2. At this time, a control signal for switching the flow direction of the refrigerant is not transmitted to the switching valve 60 and the first and second flow direction changing valves 62 and 64. Hence, the refrigerant circulates in the direction shown in FIG. 3 during the refrigerating mode.

Figure 4:
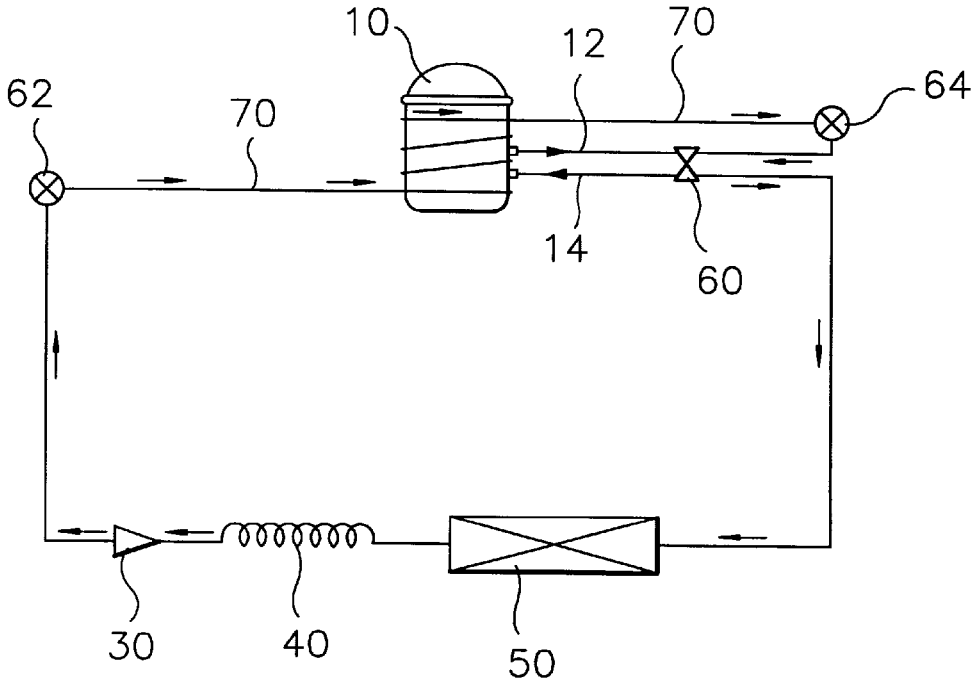
FIG. 4 is a circulation chart of the refrigerant in a defrosting mode of the refrigerator according to the present invention.

FIG. 4 shows the circulation of the refrigerant in the defrosting mode of FIG. 2. At this time, the switching valve 60 receives the control signal from the controller according to the amount of the frost formed on the evaporator 50, thereby switching the operating mode into the defrosting mode. Accordingly, the compressed refrigerant flows reversely, that is, directly to the evaporator 50, bypassing the condensor 20, while passing through the switching valve 60. Further, the first and second flow direction changing valves 62 and 64 are also actuated by the control signal from the controller to change the direction of the refrigerant. After passing through the evaporator 50, the refrigerant returns to the compressor 10, not to the condensor 20, by the actuation of the first and second flow direction changing valves 62 and 64.

In the defrosting mode, the refrigerant compressed to the high-temperature and high-pressure gas at the compressor 10 and flowing directly to the evaporator 50 can remove the frost formed on its surface effectively.

The auxiliary pipe 70 connecting the first flow direction changing valve 62 and the second flow direction changing valve 64 is coiled around the compressor 10 by several turns, so that any refrigerant condensed while passing through the evaporator 50 is vaporized by heat generated at the compressor 10 while passing through the auxiliary pipe 70, prior to being input to the compressor 10.

When the frost is completely removed in the defrosting process, the switching valve 60 and the first and second flow direction changing valves 62 and 64 are switched to the refrigerating mode through a control signal from the controller.

As described above, in the refrigerator according to the present invention, the frost formed on the evaporator 50 can be removed efficiently without a defrosting heater. That is, when the operating mode of the refrigerator is changed from the ordinary refrigerating mode to the defrosting mode, the refrigerant flows in the opposite direction, so that the refrigerant from the compressor 10 is directly transferred to the evaporator 50 to remove the frost formed on the surface of the evaporator 50.

Also, the refrigerant liquefied at the evaporator is vaporized while passing through the auxiliary refrigerating pipe 70 and then input to the compressor 10, so that the compressor 10 is not burdened with the liquefied refrigerant. Additionally, since the selective change of the flow direction of the refrigerant is possible without a defrosting heater, an additional space to accommodate the heater is not needed.

While this invention has been described in connection with what is presently considered to be the most practical and preferred embodiments, it is to be understood that the invention is not limited to the disclosed embodiment, but, on the contrary, it is intended to cover various modifications and equivalent arrangements included within the spirit and scope of the appended claims.

What is claimed is:

1. A refrigerator having a compressor, a condensor, a capillary tube, and an evaporator in which a refrigerant circulates through said compressor, said condensor, said capillary tube and said evaporator sequentially, in a refrigerating mode to perform cooling, comprising:

a switching valve installed at a discharge pipe and a suction pipe of said compressor;

a first flow direction changing valve installed between said evaporator and said condensor;

a second flow direction changing valve installed between said compressor and said condensor; and an auxiliary pipe installed between said first and second flow direction changing valves, wherein said auxiliary pipe is coiled around said compressor more than one turn.

* * * * *